US005769371A

United States Patent [19]

Bandur

[11] Patent Number: 5,769,371

[45] Date of Patent: Jun. 23, 1998

[54] ADJUSTABLE LEVELING STAND

[76] Inventor: Kenneth B. Bandur, 947 Van Auken Cir., Palo Alto, Calif. 94303

[21] Appl. No.: 658,759

[22] Filed: Jun. 5, 1996

Related U.S. Application Data

[60] Provisional application No. 60/000,118, Jun. 9, 1995.

[51] Int. Cl.[6] ..... F16M 11/20

[52] U.S. Cl. ..... 248/188.2; 248/157; 248/176.3; 248/188.8; 248/188.91

[58] Field of Search ..... 248/162.1, 918, 248/188.2, 157, 176.3, 188.4, 188.8, 188.91, 158, 161, 159, 541, 649; 482/104

[56] References Cited

U.S. PATENT DOCUMENTS

| | | | |
|---|---|---|---|
| 1,046,720 | 12/1912 | Barnes | 248/161 |
| 1,199,770 | 10/1916 | Elphinstone | 248/161 |
| 2,366,867 | 1/1945 | Nichthauser | 248/188.2 |
| 2,750,709 | 6/1956 | Saverino | 248/188.2 X |
| 3,741,509 | 6/1973 | Kelly | 248/161 X |
| 3,908,943 | 9/1975 | Bannister | 248/159 |
| 4,032,099 | 6/1977 | Maude | 248/188.2 |
| 4,073,454 | 2/1978 | Sauber | 248/188.2 |
| 4,205,838 | 6/1980 | McIntosh | 482/104 X |
| 4,773,642 | 9/1988 | Cruz | 482/104 |
| 4,804,162 | 2/1989 | Rice | 248/649 X |
| 5,035,395 | 7/1991 | Settlemier et al. | 248/188.2 X |
| 5,207,406 | 5/1993 | Stine et al. | 248/514 |
| 5,333,825 | 8/1994 | Christensen | 248/188.2 |
| 5,345,631 | 9/1994 | Saperstein et al. | 248/188.2 X |

FOREIGN PATENT DOCUMENTS

| | | | |
|---|---|---|---|
| 1273145 | 7/1968 | Germany | 248/159 |
| 2331879 | 1/1974 | Germany | 248/159 |

*Primary Examiner*—Robert W. Gibson, Jr.
*Assistant Examiner*—Donald J. Wallace
*Attorney, Agent, or Firm*—Janis Biksa

[57] ABSTRACT

A stand for adjusting the height and level of seats, tables, beds, and related devices increasing the usability and comfort of said devices. Said stand consists of two support pedestals (12) connected by two crossbar braces(10) that are pressed into place to form the base. Two leg brackets (16) are placed into holes (18) or (18A) depending on the height and angle adjustment desired. To further adjust the height, spacers (14) can be inserted into leg brackets (16), and holes (18) or (18A). Said stand can be used to raise and support a metal bed frame with bed leg brackets (20). Related devices can be adapted to said stand by using custom leg brackets.

8 Claims, 3 Drawing Sheets

ADJUSTABLE LEVELING STAND

This application claims priority from Provisional application Ser. No. 60/000,118 filed on Jun. 9, 1995, to the extent of the disclosure therein. To the extent that the present application exceeds the disclosure therein, if at all, this application is a continuation in part of the earlier application.

BACKGROUND-FIELD OF INVENTION

This invention relates to seats, tables, beds, and related devices.

BACKGROUND-DESCRIPTION OF PRIOR ART

Stands of various designs have been in existence for some time, however no prior art for attachable adjustable leveling stands for seats, tables, beds, and related devices were found.

OBJECTS AND ADVANTAGES

Several objects and advantages of the present invention are:

(a) to provide a stand which is easy to adjust;

(b) to provide a stand which is adaptable to a variety of devices;

(c) to provide a stand that increases usability of said devices;

Further objects and advantages are to provide a stand that is simple to use, increases comfort, inexpensive to manufacture, and can be attached to different devices. Still further objects and advantages will become apparent from a consideration of the ensuing description and drawing.

DRAWING FIGURES

REFERENCE NUMERALS IN DRAWINGS

10 crossbar braces

12 support pedestals

14 spacers

16 leg brackets

18 holes

20 bed leg brackets

DESCRIPTION-FIGS. 1 TO 3

Figure 1:
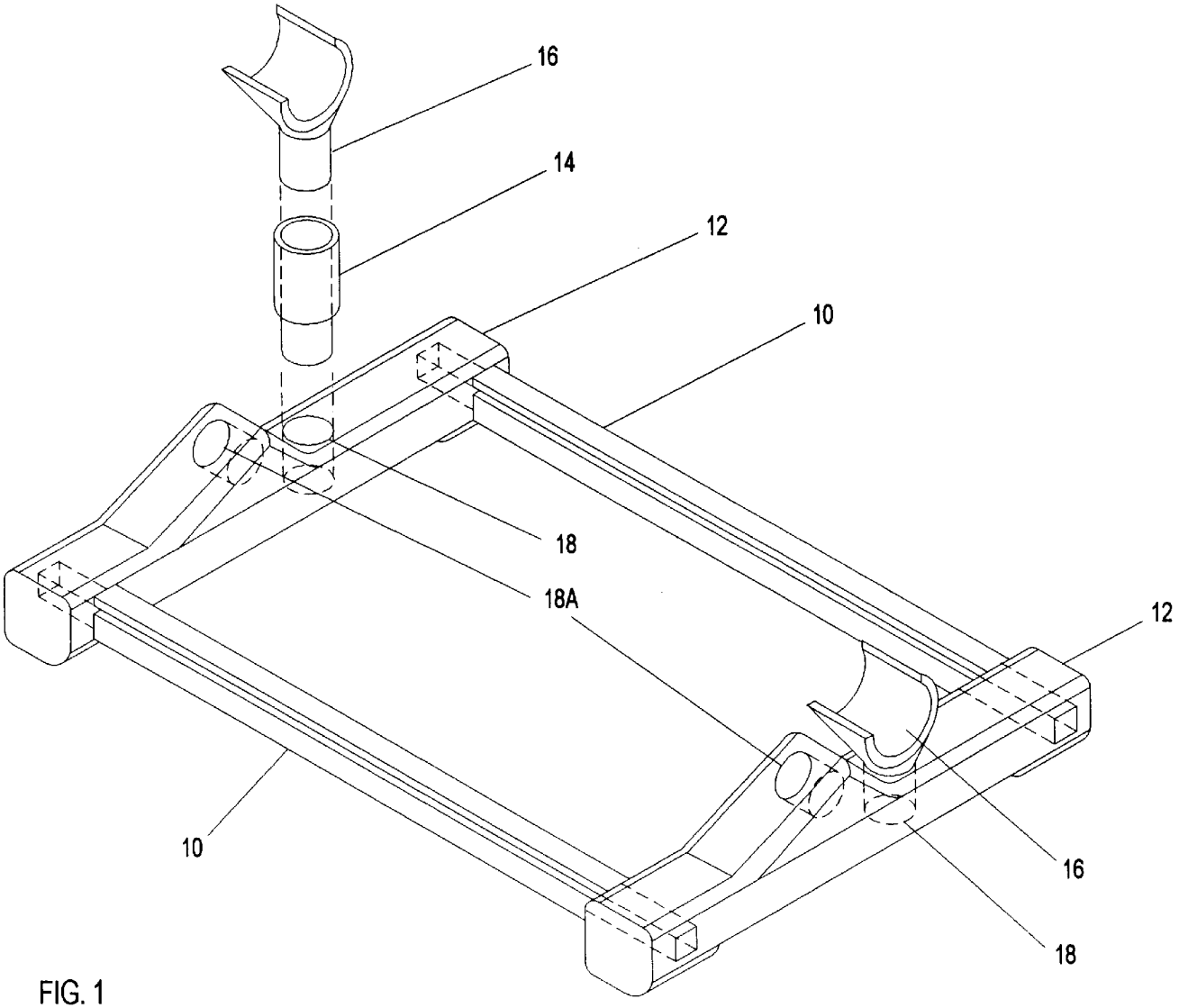
FIG. 1 shows an adjustable leveling stand used with seats or tables.
Figure 2:
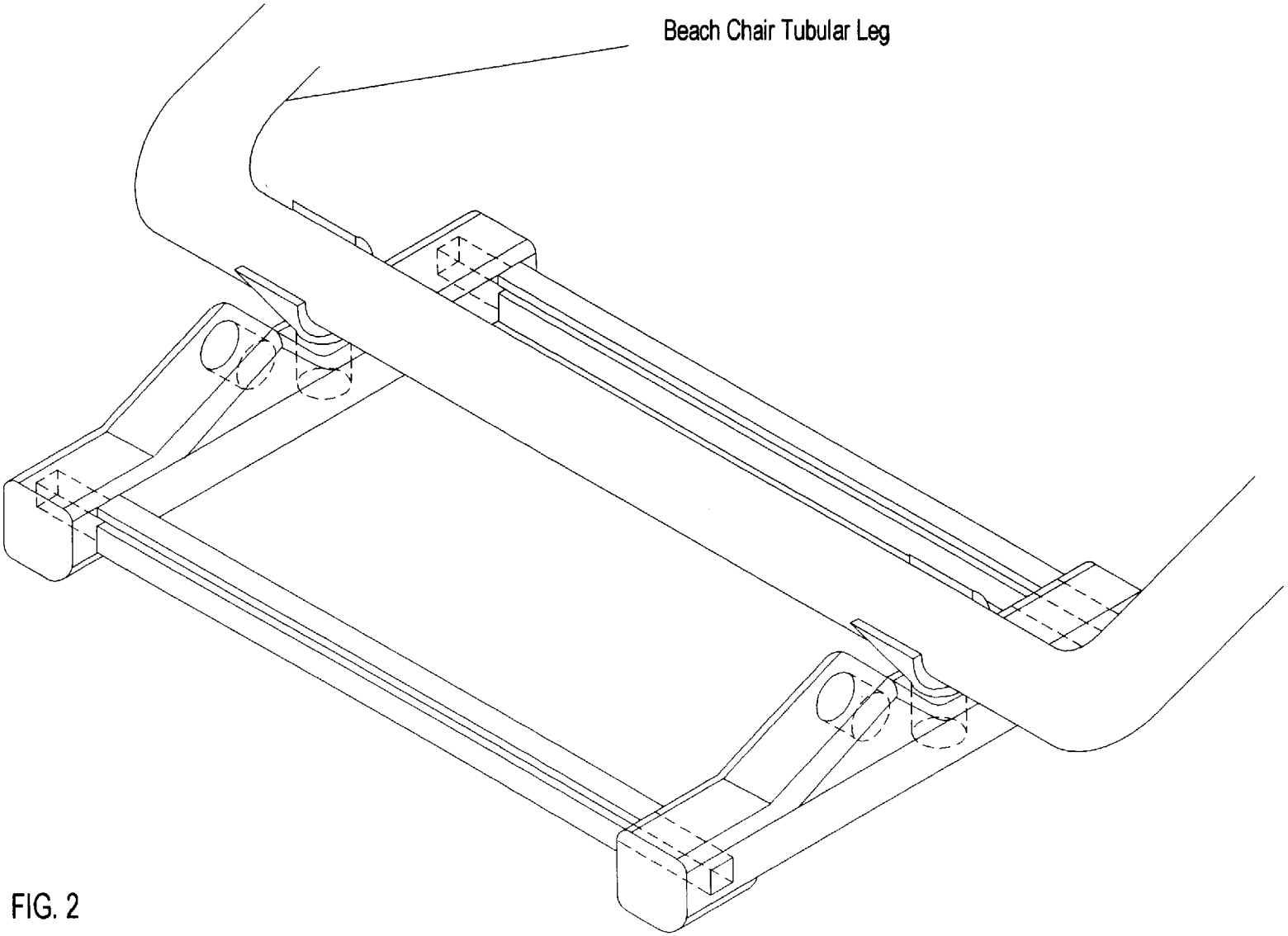
FIG. 2 Shows said stand with tubular legs of said seats or tables inserted in place.
Figure 3:
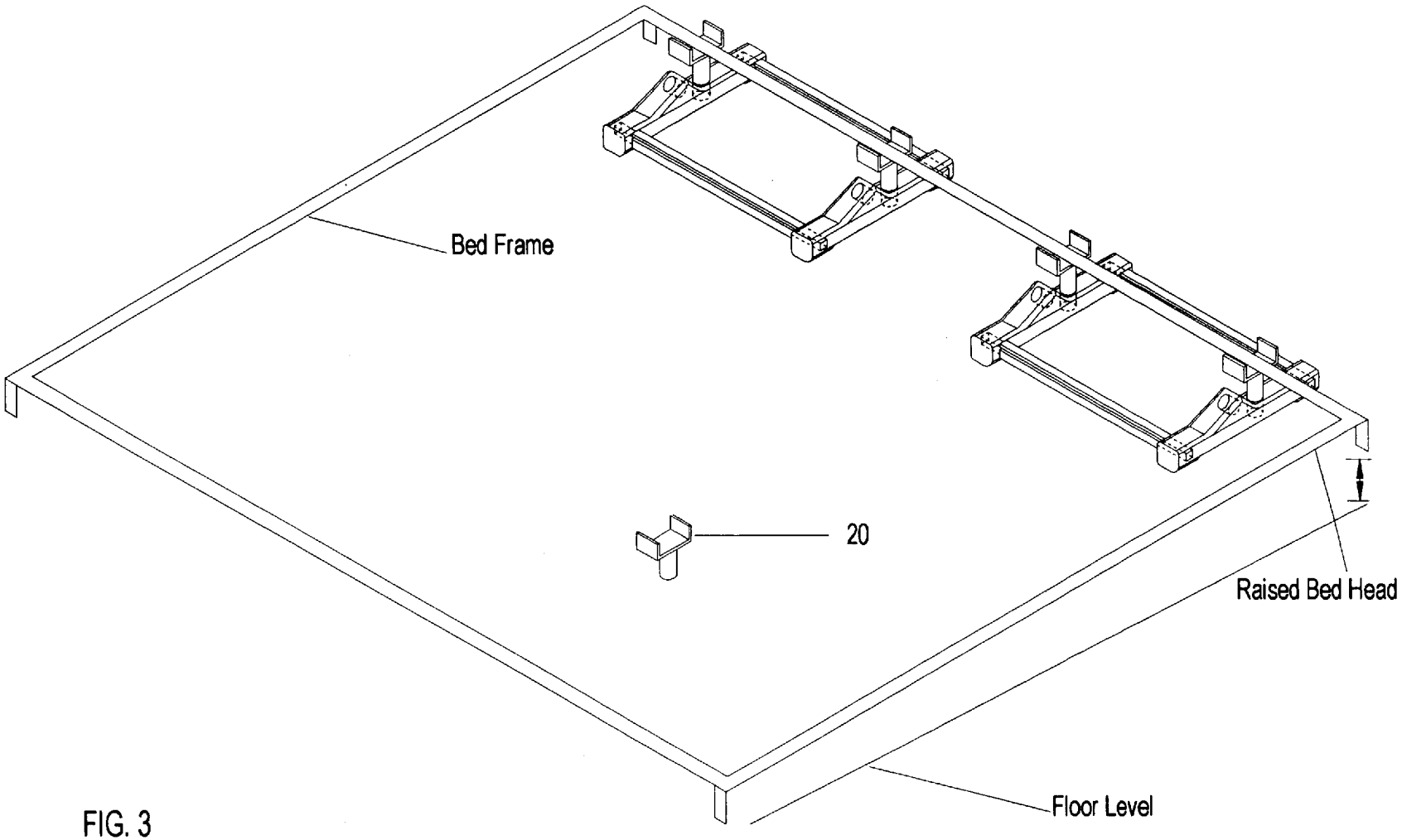
FIG. 3 Shows two said stands used with a bed.

A typical adjustable leveling stand made of plastic, used for tubular constructed seats or tables is illustrated in FIG. 1 (perspective view). FIG. 2 (perspective view) shows the tubular seat or table legs in place, and FIG. 3 shows two said stands used for raising the head of a bed.

Said stand consists of two support pedestals 12 connected by two crossbar braces 10 that are pressed into place to form a substantially flat base, as can be seen in the Figures. Two leg brackets 16 are placed into holes (leg bracket receiving openings) 18 or 18A depending on the height and angle adjustment desired. To further adjust the height, spacers 14 can be inserted into leg brackets 16, and holes 18 or 18A. FIG. 3 shows said stand using bed leg brackets 20 to adapt to metal bed frame.

Dimensions and material composition of said stand may vary to allow for different strength and size requirements of said devices.

The use of symmetrical parts provides easy assembly and reduced cost of manufacturing. Spacers 14 can be of various sizes to accommodate different height requirements. Spacers are configured at one end to slidably receive the stem of said leg bracket and at the other end to slidably mate with the stem receiving openings in the base, and are used to increase the distance that the tubular leg being supported is spaced from the base. Holes 18 are oriented to be substantially perpendicular to the base, while holes 18A are oriented at an angle other than perpendicular to the base. Holes 18 are used when a small degree of leveling is necessary. Holes 18A are generally used when said stand is used on a steeper slope that requires an angle adjustment for additional stability. Crossbar braces 10 are designed to stabilize support pedestals 12 from twisting and bending and may vary in length to fit the desired device. Custom leg brackets can be designed to attach to related devices. Material composition and specific design of said stand can vary as a device requires.

OPERATION-FIGS. 1, 2, 3

The manner of using an adjustable leveling stand for seats with tubular legs, such as folding beach chairs, is shown in FIGS. 1 and 2. Simply snap the said chairs front tubular legs into a set of leg brackets 16. Each leg bracket 16 has a saddle portion which in some instances merely supports and in other instances is sized to snap around and be retained in an engaged relationship with the horizontal tubular leg. The stem of the leg bracket is oriented generally perpendicular to a tubular leg engaged by the saddle portion. Depending on the degree of slope and the individual choice of the user, leg brackets 16 are then inserted into holes 18 or 18A with or without spacers 14. This will adjust the front legs of said chair to compensate for the degree of the slope. This can increase the leveling of said chair into a level or reclining position for greater comfort.

The manner of using said stand for tables with tubular legs, such as folding camping tables, is the same as said chair example. The difference being that the user will adjust the height to the most level position for cooking and eating purposes.

The manner of using said stand for beds with a metal frame is shown in FIG. 3. Two said stands with bed brackets 20 are placed under the outer most parts at the head of the bed frame. Height adjustment is be dependent on the particular needs of the user.

The above examples of operation are not exclusive and other methods of operation may vary from application to application.

SUMMARY, RAMIFICATIONS, AND SCOPE

Accordingly, the reader will see that the adjustability, and versatility of this adjustable leveling stand can be applied to many seats, tables, beds, and related devices, that by doing so will increase the usability of said devices providing additional comfort to the user. The ability to adjust the level of front legs on seats such as beach chairs, tables such as folding camping tables, adds to the comfort and usability of such devices. When used to raise the head of a bed, which is the general prescription of doctors for people with hiatal hernias, the user is provided with a simple, inexpensive, secure means to alleviate the painful results of sleeping on a flat bed.

Although the description above contains many specificity's, these should not be construed as limiting the scope of the adjustable leveling device but as merely providing illustrations of some of the presently preferred embodiments of this device. For example, the said stand can have other shapes, such as circular, oval, trapezoidal, triangular, etc.; the leg brackets can have other shapes that adapt it to particular devices.

Thus the scope of the adjustable leveling device should be determined by the appended claims and their legal equivalents, rather than by the examples given.

I claim:

1. An adjustable stand for supporting a horizontally oriented tubular leg of a seat, table, or bed comprising:

a set of leg brackets, each leg bracket configured to have a saddle portion for receiving a portion of the horizontally oriented tubular leg, said leg bracket having a stem which extends in a direction which is substantially perpendicular to the horizontally oriented tubular leg when the saddle of said leg bracket is engaged with and supporting the horizontally oriented leg;

a base having a set of leg bracket receiving openings aligned in a plane, each hole being configured to slidably receive a stem of each leg bracket so as to support said horizontally oriented tubular leg when engaged with said saddle portions of said leg brackets in a spaced relationship from said base, wherein said base, prior to engagement with said set of leg brackets, has a substantially flat configuration.

2. The adjustable stand for supporting a horizontally oriented tubular leg of a seat, table, or bed as in claim 1, where the saddle portion of each leg bracket is sized to snap into engagement with said tubular leg.

3. The adjustable stand for supporting a horizontally oriented tubular leg of a seat, table, or bed as in claim 1, where spacers configured at one end to slidably receive the stem of said leg bracket and, at the other end to slidably mate with the stem receiving openings in said base, are used to increase the distance that the tubular leg is spaced from the base.

4. The adjustable stand for supporting a horizontally oriented tubular leg of a seat, table, or bed as in claim 1, where the leg bracket receiving openings are substantially perpendicular to the base.

5. The adjustable stand for supporting a horizontally oriented tubular leg of a seat, table, or bed as in claim 1, where the leg bracket receiving openings are oriented at an angle other than substantially perpendicular to the base.

6. The adjustable stand for supporting a horizontally oriented tubular leg of a seat, table, or bed as in claim 1, where the base includes a first set and a second set of leg bracket receiving openings, where the first set provides support to hold the stems of the leg brackets substantially perpendicular to the base and the second set provides support to hold the leg bracket at an angle which is not substantially perpendicular to the base.

7. The adjustable stand for supporting a horizontally oriented tubular leg of a seat, table, or bed as in claim 3, where the leg bracket receiving openings are oriented at an angle other than substantially perpendicular to the base.

8. The adjustable stand for supporting a horizontally oriented tubular leg of a seat, table, or bed as in claim 3, where the base includes a first set and a second set of leg bracket receiving openings, where the first set provides support to hold the stems of the leg brackets or spacers substantially perpendicular to the base and the second set provides support to hold the leg brackets or spacers at an angle which is not substantially perpendicular to the base.

* * * * *